US010065788B2

(12) United States Patent
Fagen et al.

(10) Patent No.: US 10,065,788 B2
(45) Date of Patent: Sep. 4, 2018

(54) PILL DISPENSER WITH CYLINDRICAL PACKAGE HOLDER FOR ARRAY-TYPE PACKAGES

(71) Applicant: MEDIPENSE INC., Montreal (CA)

(72) Inventors: Terry Fagen, Saint-Lazare (CA); Hesham El-Adly, Montreal (CA)

(73) Assignee: MEDIPENSE INC., Montreal (CA)

( * ) Notice: Subject to any disclaimer, the term of this patent is extended or adjusted under 35 U.S.C. 154(b) by 17 days.

(21) Appl. No.: 15/324,185

(22) PCT Filed: Jul. 8, 2015

(86) PCT No.: PCT/CA2015/050632

§ 371 (c)(1),
(2) Date: Jan. 5, 2017

(87) PCT Pub. No.: WO2016/004529

PCT Pub. Date: Jan. 14, 2016

(65) Prior Publication Data

US 2017/0197775 A1 Jul. 13, 2017

Related U.S. Application Data

(60) Provisional application No. 62/046,312, filed on Sep. 5, 2014, provisional application No. 62/021,849, filed on Jul. 8, 2014.

(51) Int. Cl.
*B65D 83/00* (2006.01)
*B65D 83/04* (2006.01)
(Continued)

(52) U.S. Cl.
CPC ..... *B65D 83/0463* (2013.01); *A61J 1/035* (2013.01); *A61J 7/0454* (2015.05); *A61J 7/0481* (2013.01); *B65B 69/0033* (2013.01)

(58) Field of Classification Search
None
See application file for complete search history.

(56) References Cited

U.S. PATENT DOCUMENTS 3,654,890 A * 4/1972 Rigney ..... A61J 7/04 116/308
4,798,309 A * 1/1989 Stone ..... A61J 7/0481 221/15

(Continued)

FOREIGN PATENT DOCUMENTS

CA 2334950 A1 12/1999
CA 2334950 C 12/2007

OTHER PUBLICATIONS

International Search Report and Written Opinion for International Application No. PCT/CA2015/050632 dated Oct. 14, 2015.

(Continued)

*Primary Examiner* — Timothy R Waggoner
*Assistant Examiner* — Stepehn L Akridge
(74) *Attorney, Agent, or Firm* — Lando & Anastasi, LLP

(57) ABSTRACT

A dispenser for dispensing pills stored into any one of a plurality of individual containers of an array-type pill package is provided. The individual containers have a generally flexible common top surface and all extend on a same side. The 5 dispenser includes a cylindrical package holder having a cylindrical periphery configured for holding the array-type pill package thereon with the individual containers projecting radially away and is rotatably mounted on a chassis. A controller system controls the rotation of the cylindrical package holder to bring a selected one of the individual containers in alignment with a pill extracting 10 mechanism.

12 Claims, 6 Drawing Sheets

(51) Int. Cl.

| | |
|---|---|
| ***B65B 69/00*** | (2006.01) |
| ***A61J 7/04*** | (2006.01) |
| ***A61J 1/03*** | (2006.01) |

(56) References Cited

U.S. PATENT DOCUMENTS

| | | | | |
|---|---|---|---|---|
| 5,377,864 | A | 1/1995 | Blechl et al. | |
| 5,405,011 | A * | 4/1995 | Haber | B65D 83/0463 206/531 |
| 5,497,763 | A * | 3/1996 | Lloyd | A61K 51/1206 128/200.14 |
| 5,571,258 | A | 11/1996 | Pearson | |
| 5,657,236 | A | 8/1997 | Conkright | |
| 5,788,079 | A | 8/1998 | Bouthiette | |
| 5,883,806 | A | 3/1999 | Meador et al. | |
| 6,011,999 | A | 1/2000 | Holmes | |
| 6,021,623 | A | 2/2000 | Bouthiette | |
| 6,023,916 | A | 2/2000 | Bouthiette | |
| 6,026,726 | A | 2/2000 | Bouthiette | |
| 6,318,051 | B1 | 11/2001 | Preiss | |
| 6,338,007 | B1 | 1/2002 | Broadfield et al. | |
| 6,471,087 | B1 | 10/2002 | Shusterman | |
| 6,510,668 | B2 | 1/2003 | Kim | |
| 6,574,166 | B2 * | 6/2003 | Niemiec | A61J 7/0481 206/531 |
| 6,585,132 | B2 | 7/2003 | Kim | |
| 6,594,549 | B2 | 7/2003 | Siegel | |
| 6,607,094 | B2 | 8/2003 | Macdonald | |
| 6,612,461 | B2 * | 9/2003 | Layer | A61J 7/0481 221/25 |
| 6,650,964 | B2 | 11/2003 | Spano, Jr. et al. | |
| 6,681,935 | B1 | 1/2004 | Lewis | |
| 6,805,259 | B2 | 10/2004 | Stevens et al. | |
| 6,887,431 | B1 | 5/2005 | Vann et al. | |
| 6,961,285 | B2 | 11/2005 | Niemiec et al. | |
| 7,139,639 | B2 | 11/2006 | Broussard et al. | |
| 7,418,311 | B1 | 8/2008 | Lagassey et al. | |
| 7,885,725 | B2 | 2/2011 | Dunn | |
| 8,032,252 | B2 | 10/2011 | Berg | |
| 8,061,109 | B2 | 11/2011 | Freudelsperger | |
| 8,068,934 | B2 * | 11/2011 | Saltsov | A61J 7/0084 221/121 |
| 8,230,662 | B2 | 7/2012 | Boutin | |
| 8,326,455 | B2 | 12/2012 | Dunn | |
| 8,527,090 | B2 | 9/2013 | Monto et al. | |
| 8,733,217 | B2 | 5/2014 | Yuyama et al. | |
| 8,874,260 | B2 * | 10/2014 | Saltsov | A61J 7/0076 700/236 |
| 9,245,093 | B2 * | 1/2016 | Shaw | G06F 19/3462 |
| 9,400,873 | B2 | 7/2016 | Kamen et al. | |
| 2003/0120384 | A1 | 6/2003 | Haitin | |
| 2004/0094564 | A1 * | 5/2004 | Papp | A61J 7/0084 221/25 |
| 2004/0158350 | A1 * | 8/2004 | Ostergaard | A61J 7/0481 700/231 |
| 2005/0082194 | A1 * | 4/2005 | Fry | A61J 1/035 206/531 |
| 2005/0237222 | A1 * | 10/2005 | Bogash | A61J 1/035 340/870.07 |
| 2005/0274643 | A1 * | 12/2005 | Arnold | B65D 75/327 206/531 |
| 2009/0065525 | A1 | 3/2009 | Shen et al. | |

OTHER PUBLICATIONS

International Search Report and Written Opinion for International Application No. PCT/CA2015/050633 dated Oct. 14, 2015.

* cited by examiner

PILL DISPENSER WITH CYLINDRICAL PACKAGE HOLDER FOR ARRAY-TYPE PACKAGES

RELATED PATENT APPLICATIONS

The present application is a U.S. National Stage Application under 35 U.S.C. § 371 of PCT Application Serial No. PCT/CA2015/050632 filed on Jul. 8, 2015, which claims priority from U.S. provisional patent application No. 62/021,849 filed on Jul. 8, 2014 and entitled "CYLINDRICAL-SHAPED PILL DISPENSER FOR ARRAY-TYPE PACKAGES" as well as from U.S. provisional patent application No. 62/046,312 filed on Sep. 5, 2014 and entitled "HOLDING MECHANISM FOR ARRAY-TYPE PACKAGES". The contents of both of these applications are each incorporated herein by reference in their entirety.

TECHNICAL FIELD

The present invention relates to dispensers, and more specifically to a dispenser for array-type pill packages.

BACKGROUND

There are many types of medication packages provided with a plurality of independent or individual small containers connected to one another at a common top surface. Each individual container contains a predetermined set of one or more medication pills to be taken a specific day, and at a predetermined time by the patient. These type of packages are usually prepared in advance by a pharmacist or other health professional and it is the responsibility of the patient, or a caregiver thereof (for example a relative, spouse, visiting health professional, etc.), to take each set of pill(s) at the right time, the right day, and not to make any mistake on the specific individual container it is time to open.

In order to prevent the loss, the unintentional mix and/or the non-taking (omission or forgetting) of the medication at the proper time/day, there exists automatic medication dispensers. Among these dispensers, individual dispensers, located at the patient living place, are typically filled with one, two, three or even several predetermined pills that would be distributed to the patient whenever required but are not adapted to function with multiple individual container packages arranged into an array-type configuration, with all containers extending on a same side of a common (top) surface typically made out of coated paper or similar material covering the containers typically made out of plastic (PVC—polyvinyl chloride) material or the like. To get the proper selection of pills at any particular time, the patient needs first to properly locate the individual container among the multiple containers, and typically tear it off from the package. To access the pills of the specific individual container, the patient then typically needs to either peel off or perforate the top cover of the container using a sharp tool or the like.

Apparatuses for simultaneously opening all of the individual containers simultaneously, typically by chopping the entire top surface off using an elongated knife, are known in the art. Such an apparatus is only used by pharmacists that would have to recuperate all unused pills or simply for refill into another package, and would be useless to a patient. Known dispensers are not capable of dispensing the content of any selected individual container within an array, especially not dispensing the content into its original container.

There remains is a need for an improved dispenser for array-type packages.

SUMMARY

It is an object of the present invention to provide an improved dispenser for array-type packages.

In accordance with one aspect, there is provided a dispenser for dispensing pills stored into any one of a plurality of individual containers of an array-type pill package, the individual containers being attached to one another in an arrangement of rows and columns and having a common top surface. The common top surface is generally flexible and has all of the individual containers extending therefrom on a side thereof The dispenser includes a chassis and a cylindrical package holder having a longitudinal axis and a cylindrical periphery configured for holding the array-type pill package thereon with the individual containers projecting radially away from the cylindrical package holder. The cylindrical package holder is mounted on the chassis rotatably about its longitudinal axis.

The dispenser also includes a pill extracting mechanism mounted on the chassis for selectively extracting and dispensing the pills located into a selected one of the individual containers.

Finally, the dispenser includes a controller system controlling a rotation of the cylindrical package holder relative to the chassis about the longitudinal axis and configured to rotate the cylindrical package holder to bring the selected one of the individual containers in alignment with the pill extracting mechanism.

Preferably, the pill extracting mechanism is positioned underneath the cylindrical package holder.

In some implementations, the dispenser further includes a gear train mounted between the chassis and the cylindrical package holder, and a holder motor electrically connected to the controller system and collaborating with the gear train to rotate the cylindrical package holder.

The pill extracting mechanism may include a cutting mechanism connected to the chassis and configured for cutting a side wall of the selected one of the individual containers adjacent to the common top surface to thereby entirely detach the selected one of the individual containers from the array-type package with the pills remaining therein. In some implementations, the cutting mechanism includes a cutting tool movably mounted onto the chassis along at least an axis parallel to the longitudinal axis of the cylindrical package holder.

In some implementations, the cylindrical package holder is configured for holding at least two array-type pill packages contiguously on its cylindrical periphery.

In accordance with some embodiments, the dispenser may further include a clamping frame configured for holding the array-type package against the cylindrical package holder. The clamping frame is preferably movably connected to the cylindrical package holder between a latched configuration and an unlatched configuration. Preferably, the clamping frame is hingedly mounted onto the cylindrical package holder, and is generally flexible so as to define a generally cylindrically curved shape when in the latched configuration and a generally planar shape when in the unlatched configuration.

The dispenser may also include a registering mechanism mounted to at least one of the cylindrical package holder and the clamping frame for registering the array-type package with the cylindrical package holder. The registering mechanism may for example include a plurality of through openings each shaped and positioned to tightly receive a corresponding one of the plurality of individual containers of the array-type package.

In accordance with some implementations, the dispenser further includes a latching mechanism connected to the cylindrical package holder and the clamping frame to releasably latch the clamping frame onto the cylindrical package holder when in the latched configuration, with the common top surface of the array-type package held therebetween.

An advantage of embodiments of the present invention is that the dispenser can dispense the pills (or the like) of any individual container of the array-type package at a time, irrespective of the location of the container within the array. The cylindrical shape of the dispenser allows for simpler pill extraction mechanism, and dispensing mechanism, while maintaining relative compactness of the dispenser.

Another advantage is that the dispenser can dispense the pills of any individual container into the original container.

Advantageously, in some implementations the dispenser allows for a relatively easy installation of a new array-type pill package and removal of a used or empty one, not requiring any skilled technician.

Still another advantage of some embodiments is that the dispenser may simultaneously carry a plurality of array-type pill packages to avoid any interruption period of pill dispensing to the patient.

Further advantageously, in some implementations the dispenser communicates with the patient when it is time to take medications, when a scheduled appointment or calendar event is evident, and when a caregiver attempts to contact the patient.

The dispenser may also capture and record all dispensing events and maintains an audit trail of all events. In some embodiments, the dispenser may communicate, store and retrieve data, securely, in the cloud computing.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION

With reference to the annexed drawings the preferred embodiment of the present invention will be herein described for indicative purpose and by no means as of limitation.

Referring to FIGS. 1 through 6, there is shown a dispenser 11 for dispensing pills stored into any one of a plurality of individual containers 14 of an array-type pill package 12 in accordance with one embodiment.

Figure 5:
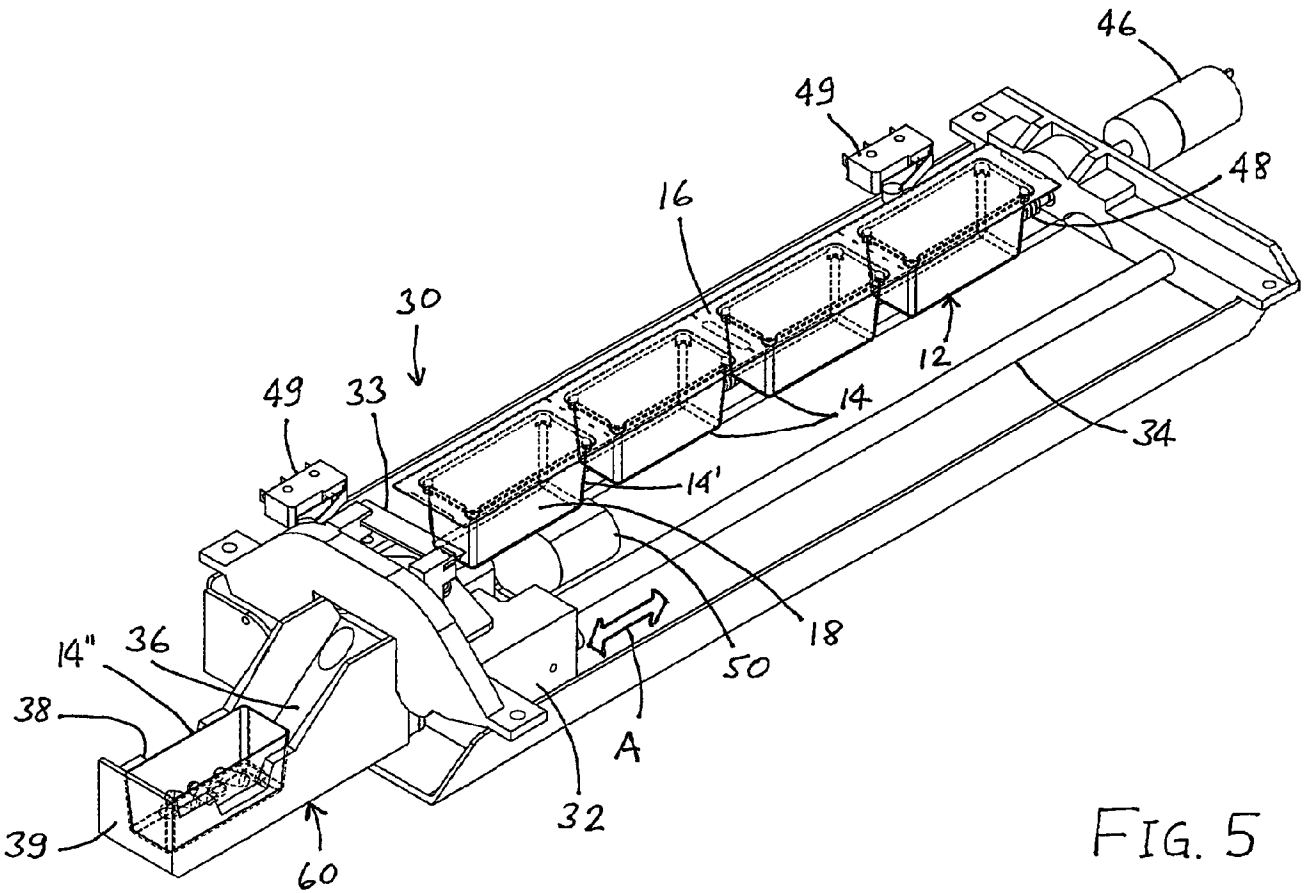
FIGS. 5 and 6 are partially broken enlarged front and rear perspective views, showing the pill extracting mechanism.

Although the term pill is used throughout the following description, one skilled in the art would readily understand that the present invention is not limited to the dispensing of medication pills (not shown), but would also encompass the dispensing of any type of pea-size (small) objects, goods or pellets (such as candies, coffee, tea, seeds or the like) contained into individual containers 14 of the array-type package 12, as shown in dotted lines into the dispensed individual container 14" of FIG. 5.

The individual containers of the array-type pill package 12 are typically attached to one another in an arrangement of rows and columns and having a common top surface 16. The common top surface 16 is generally flexible and has all of the individual containers 14 extending therefrom on a side thereof. Although seven rows and four columns are shown in the example illustrated in FIG. 3, it will be readily understood that in other variants a different number of rows and column may be provided. The common top surface 16 may for example be made of coated paper material, foil, plastic or the like, such as materials typically used for blister packaged medications or gum. The individual containers are typically made out of plastic materials such as PVC or Polypropylene. Other materials could be considered, such as for example corn-type cellulose, cardboard, etc. In the medical example, each individual container 14 typically contains a plurality of pills, all of them to be taken by the patient at a same time, according to a predetermined scheme based on the instructions of the health professional(s)—namely patient's doctor, dentist, pharmacist or the like. The dispenser 11 may for example be operated to dispense the pills according to at least some of the features of international application PCT/CA2015/050591 filed on Jun. 25, 2015 and entitled "SYSTEM AND METHOD FOR THE DISPENSING OF PILLS", the entire contents of which are incorporated herein by reference.

Figure 1:
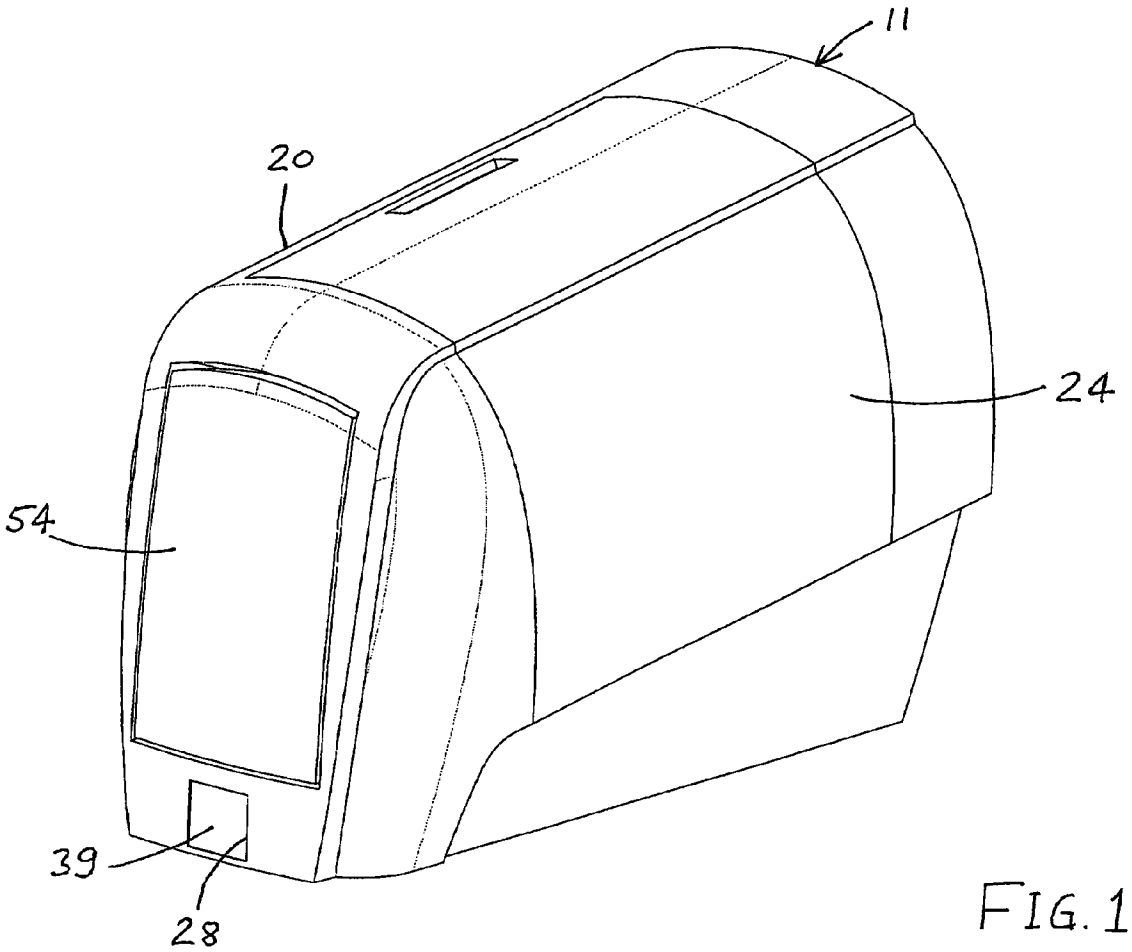
FIG. 1 is a simplified top perspective view of a dispenser for array-type pill packages in accordance with an embodiment of the present invention.
Figure 2:
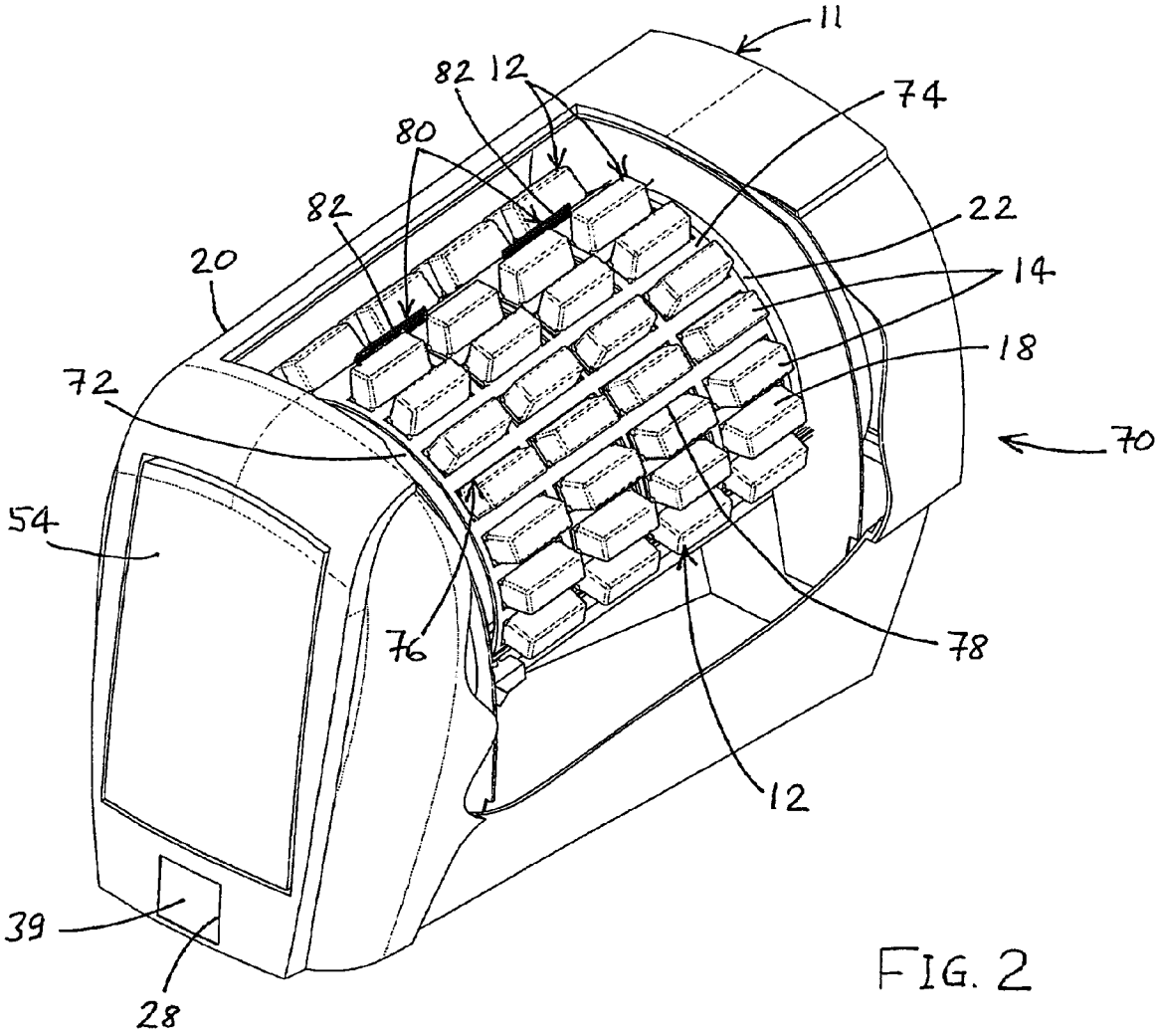
FIG. 2 is a partially broken top perspective view of the embodiment of FIG. 1, showing a cylindrical package holder.
Figure 3:
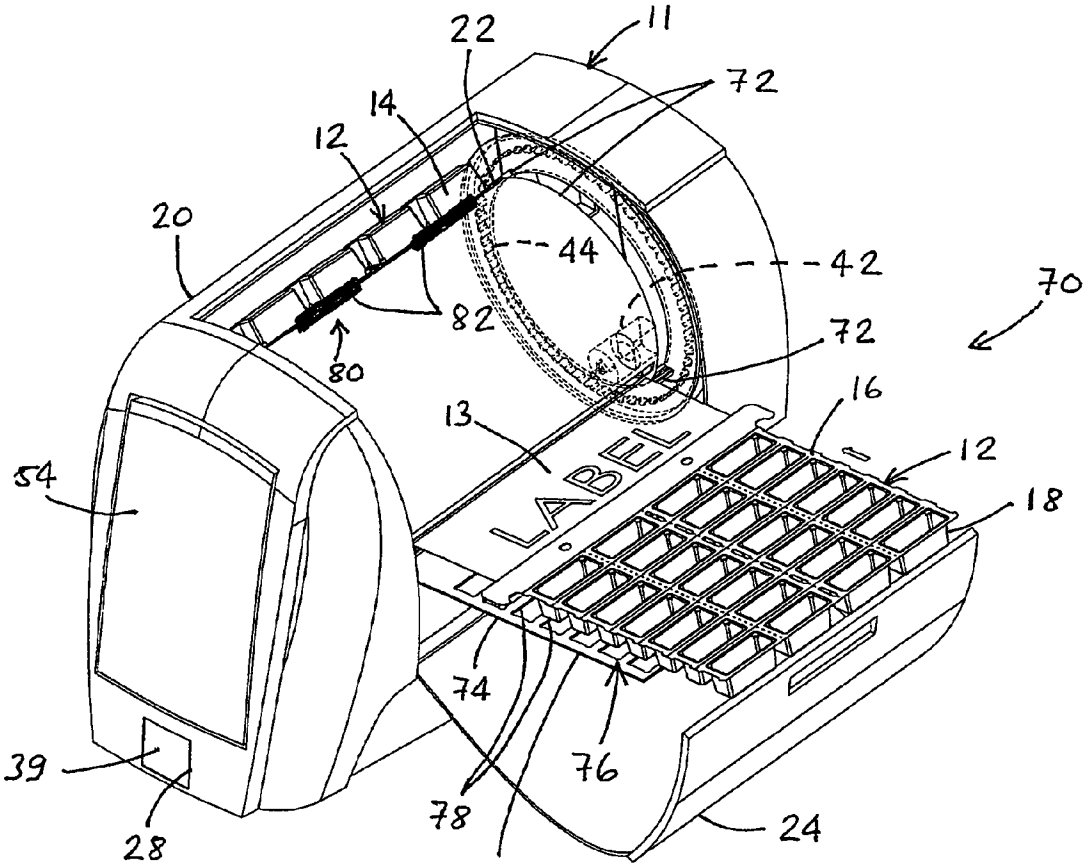
FIG. 3 is an exploded view similar to FIG. 2, showing the cylindrical package holder opened for array-type pill package installation or removal.

Referring more particularly to FIGS. 1, 2 and 3, the dispenser 11 generally includes a chassis 20 supporting all of its components, and a cylindrical package holder 22 having a longitudinal axis 23 and rotatably mounted to the chassis 20 about this longitudinal axis 23. The cylindrical package holder further has a cylindrical periphery 72 configured for holding the array-type pill package 12 with the individual containers 14 projecting radially away from the cylindrical package holder 22, as best seen in FIG. 2. Optionally, in one implementation the cylindrical package holder 22 is configured for holding two array-type pill packages 22 contiguously on the cylindrical periphery 72, or more, such that one array-type package 12 can be removed and replaced with another one while the other array-type package 12 is installed, to allow a timely dispensing of the pills (not shown) to the patient. In another implementation, two patients may share the use of the dispenser, each receiving pills from a specific one of the two array-type pill package 12.

The dispenser 11 further includes a pill extracting mechanism mounted on the chassis 20 for selectively extracting and dispensing the pills located into a selected one of the individual containers 14. A controller system 40, controlling the rotation of the cylindrical package holder 22 relative to the chassis 20 about its longitudinal axis 23, is also provided. The controller system 40 is configured to rotate the cylindrical package holder 22 to bring the selected one of the individual containers 14 in alignment with the pill extracting mechanism.

Figure 4:
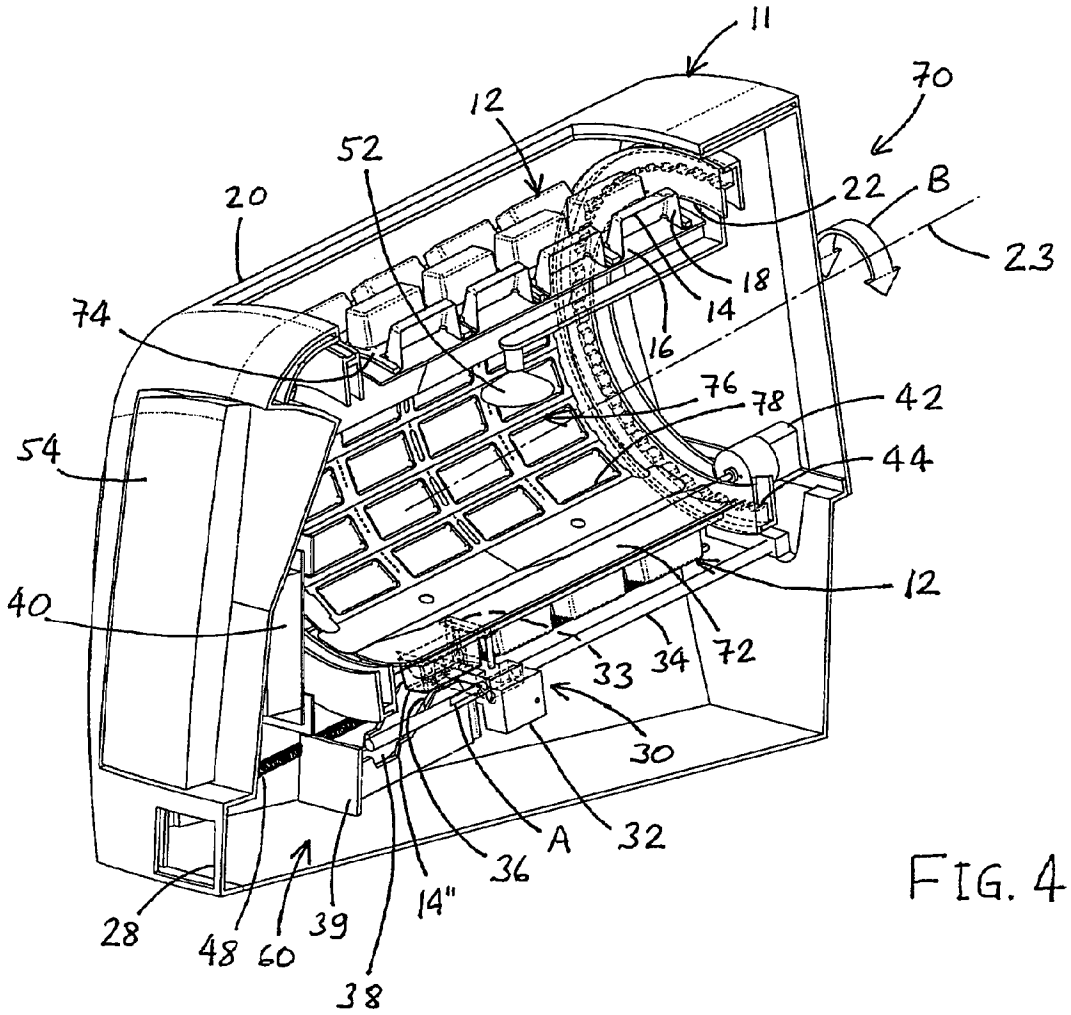
FIG. 4 is a partially broken perspective view of the embodiment of FIG. 1, showing a pill extracting mechanism.

In some implementations, the dispenser 11 may include a clamping frame 74, configured for holding the array-type package 12 against the cylindrical package holder 22. The clamping frame 74 is movably connected to the cylindrical package holder 22, preferably hingedly, between a latched configuration, in which the clamping frame presses against the cylindrical package holder 22 with the array-type package held between the two (as shown in FIGS. 2 and 4), and an unlatched configuration, in which the cylindrical package holder 22 and the clamping frame 74 are at an angled relative to one another (as shown in FIG. 3). In this embodiment, the clamping frame 74 is generally flexible so as to define a generally cylindrically curved shape when in the latched configuration and a generally planar shape when in the unlatched configuration.

Referring more particularly to FIG. 3, the dispenser may further include a registering mechanism 76 mounted to at least one of the cylindrical package holder 22 and the clamping frame 74 for registering the array-type package 12 with the cylindrical package holder 12 to ensure its proper orientation and alignment. Typically, the registering mechanism 76 may include a plurality of through openings 78 each shaped and positioned to tightly receive a corresponding one of the plurality of individual containers 14 of the array-type package 12. In the illustrated embodiment the through 78 openings are provided on the clamping frame 74. The dispenser 11 may further include a latching mechanism 80 connected to the cylindrical package holder 22 and the clamping frame 74 to releasably latch the clamping frame 74 onto the cylindrical package holder 22 when in the latched configuration, with the common top surface of the array-type package 12 held between them. The latching mechanism 80 may allow for an automatic latching of the clamping frame 74 onto the cylindrical package holder 22 when it is returned into the latched configuration by a user, and the user can easily unlatch the clamping frame 74 by simple pressure applied onto buttons 82 or the like of the latch mechanism 80, as well known in the art. The latch mechanism 80 could also be, at least partially, electrical and therefore electronically controlled.

As shown in FIG. 2, the holder 22 is typically reachable via a body cover 24. Once the cover 24 is opened, the user typically activates the latching mechanism 80 to unlatch the clamping frame 74 that will move into its unclamped configuration in which the selected array-type package 12 can be easily removed therefrom and replaced with a new one by the user, ensuring that the different individual containers 14 fit into the respective through openings 78 of the registering mechanism 76. Then, the user moves the clamping frame 74 back into the latched configuration for the secure clamping and holding of the package 12 between the cylindrical package holder 22 and the clamping frame 74. The cover may then be closed and the dispenser 11 is ready for operation.

Figure 6:
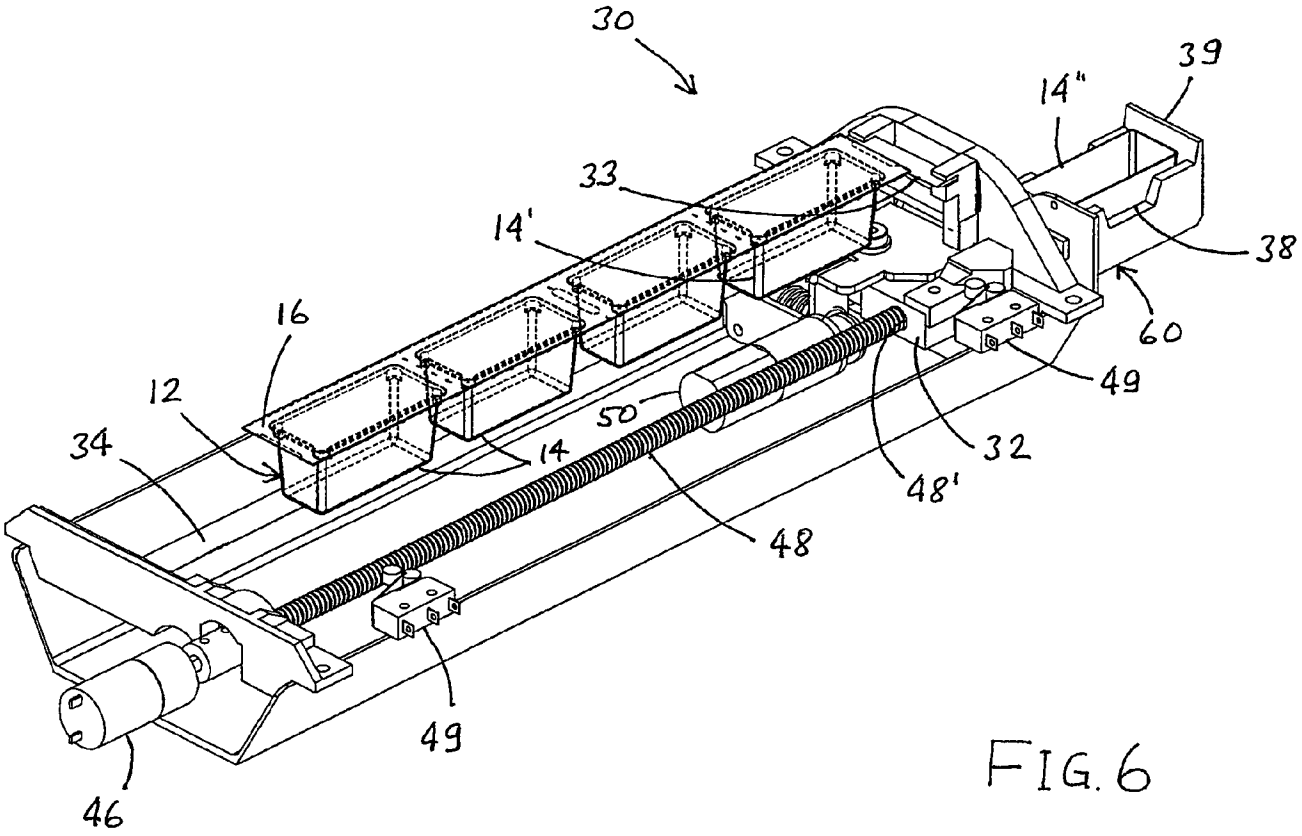

Referring more particularly to FIGS. 5 and 6, in the some embodiments the pill extracting mechanism is embodied by a cutting mechanism 30 connected to the chassis 20 and configured for cutting a side wall 18 of the selected one of the individual containers 14 adjacent to the common top surface 16. In this manner, the selected one of the individual containers 14 can be entirely detached from the array-type package 22 with the pills remaining inside this individual container 14. The cutting mechanism 30 may for example include a cutting tool 33 movably mounted onto the chassis 20 along at least one axis, for example a displacement axis B parallel to the longitudinal axis 23 of the cylindrical package holder 22. As mentioned above, the cutting tool 33 or other pill extracting mechanism is preferably positioned underneath the cylindrical package holder 22 in order for the selected one of the individual containers to fall more easily away from the cylindrical package holder 22 through the effect of gravity once it has been separated from the array-type package.

The cutting mechanism 30 may include a cutter base 32 supporting the cutting tool 33, as a sharp cutting blade or the like, adapted to entirely cut through the side wall 18 of the selected one of the individual container 14', preferably adjacent the common top surface 16. Any other cutting tool could be considered without departing from the scope of the present invention, such as, but not limited to, a laser beam, a heated wire, etc.

In some implementations, the dispenser 11 may include a gear train 44, or sprocket or the like, mounted between the chassis 20 and the cylindrical package holder 22, and a holder motor 42 electrically connected to the controller system 40 and collaborating with the gear train 44 to rotate the cylindrical package holder 22. As better seen in FIGS. 4 to 6, the controller system 40 is preferably electrically connected to the holder motor 42 to control the rotation of the cylindrical package holder 22, and therefore the array-type package 12, relative to the main chassis 20 about the longitudinal axis 23 of the cylindrical package holder 22. The controller system 40 is also electrically connected to a cutter motor 46 typically meshing with a worm screw 48 or the like for rotation thereof and linear displacement of the cutter base 32 along the displacement axis B, between first and second limit switches 49. The worm screw 48 meshes with a threaded bore 48' extending through the cutter base 32. Accordingly, in the present embodiment, the controller system 40 controls both the rotation of the cylindrical package holder 22 and the array-type package 12 relative to the chassis 20 and the displacement of the cutter base 32 relative to the chassis 20. When an array-type package 12 needs to be replaced or inserted into the dispenser 11, the controller system 40 may rotate the cylindrical package holder 22 about its longitudinal axis 23 to properly align the latching mechanism 80 to make it accessible by the user for activation when the cover 24 is opened.

Typically, the controller system 40 also electrically connects to a cutting vibration motor 50 mounted on the cutter base 32 to transversally vibrate the cutting tool 33 at the beginning of the cutting operation and facilitate the penetration of the cutting tool 33 into the plastic side wall 18.

In some embodiments, the cutter base 32 may include a dispensing member 60 typically including a guiding slide 36 adapted to receive the cut individual container 14' (with the pills therein) falling thereon, and a dispensing tray 38, located at the front of the cutter base 32 just behind the cutting tool 33, to receive the cut container 14' sliding from the guiding slide 36 for the selective extraction and dispensing of the pills located into a selected individual container 14'. The guiding slide 36 preferably slopes downward towards the dispensing tray 38. After the predetermined container 14' has been cut and then received into the dispensing tray 38 or receptacle, the cutter motor 46 moves the cutter base 32 towards the front of the chassis 20 with the dispensing tray 38 extending through a dispensing opening 28 formed into the front wall 29 of the chassis 20 to dispense the container 14' to the user, as shown in FIGS. 5-6. When not in use, the cutter motor 46 preferably positions the dispensing tray 38 into a rest location with a front wall 39 of the dispensing tray 38 substantially closing off the dispensing opening 28 (as shown in FIGS. 1-3).

Once the controller system 40 has activated the cutting mechanism 30 to cut the selected individual container 14' from the array-type package 12 and allowed it to fall into the dispensing tray 38 (as illustrated in FIG. 4), the controller system 40 then rotates the cylindrical package holder 22 about its longitudinal axis 23 to re-align the cutter base 32 with an axial zone of the cylindrical periphery 72 without any individual container 14. Then, the controller system 40 actuates the cutter base 32 to ensure the proper dispensing of the cut container 14' (as shown before being cut, as item 14', in its position in the array-type package 12 and after being cut, as item 14", into the dispensing tray 38 in FIG. 5). Typically, a plurality of internal cameras (not shown) could be located along the dispensing path (displacement of the guide slide 36 and dispensing tray 38) to image the cut containers as they are dispensed. Furthermore, an internal camera 52 (see FIG. 4) typically images and captures all the data (including information such as patient name, bar codes and any other required information) typically located on a top header 13 of each array-type package 12 (see FIG. 3 more specifically) and stores this information locally and securely in the cloud computing or the like.

Furthermore, in some implementations the controller system 40 may be connected to a display 54, such as a large interactive touch screen or the like, an external communication device (not shown), such as a port for wire or an antenna for wireless communication with an internet server to send and receive information (to and from a cloud for example), as well as a sound receiver/microphone (not shown) for sound communication, and a light device (not shown) for visual communication, and the like. Similarly, a proximity sensor or the like (not shown) may be located at the front of the dispenser 11 to detect the presence of a user which would typically make the controller system 40 to activate different features such as, but not limited to, turning on the display 54, greeting the user, having an advertisement appearing on the display, etc.

Obviously, although not illustrated herein, it would be obvious to anyone skilled in the art, without departing from the scope of the present invention, that, for example, the cutter base 32 could be displaced relative to the holder and the package 12 by two or three different motors along two or three respective axis. Also, as mentioned hereinabove, the latching mechanism 80 could be electrical and/or magnetic (and controlled via the controller system 40) without departing from the scope of the present invention.

Although the present invention has been described with a certain degree of particularity, it is to be understood that the disclosure has been made by way of example only and that the present invention is not limited to the features of the embodiments described and illustrated herein, but includes all variations and modifications within the scope of the invention as hereinafter claimed.

The invention claimed is:

1. A dispenser for dispensing pills stored into any one of a plurality of individual containers of an array-type pill package, the individual containers being attached to one another in an arrangement of rows and columns and having a common top surface, the common top surface being generally flexible and having all of the individual containers extending therefrom on a side thereof, said dispenser comprising:

a chassis;

a cylindrical package holder having a longitudinal axis and a cylindrical periphery configured for holding the array-type pill package thereon with the individual containers projecting radially away from said cylindrical package holder, the cylindrical package holder being mounted on the chassis rotatably about said longitudinal axis and retaining the individual containers at a fixed distance from the longitudinal axis as the cylindrical package holder rotates about the longitudinal axis;

a pill extracting mechanism mounted on the chassis for selectively extracting and dispensing the pills located into a selected one of the individual containers; and a controller system controlling a rotation of the cylindrical package holder relative to the chassis about said longitudinal axis and configured to rotate said cylindrical package holder to bring the selected one of the individual containers in alignment with the pill extracting mechanism.

2. The dispenser according to claim 1, wherein the pill extracting mechanism is positioned underneath the cylindrical package holder.

3. The dispenser according to claim 1, further comprising a gear train mounted between the chassis and the cylindrical package holder, and a holder motor electrically connected to the controller system and collaborating with the gear train to rotate the cylindrical package holder.

4. The dispenser according to claim 1, wherein the pill extracting mechanism comprises a cutting mechanism connected to the chassis and configured for cutting a side wall of the selected one of the individual containers adjacent to the common top surface to thereby entirely detach the selected one of the individual containers from the array-type package with the pills remaining therein.

5. The dispenser according to claim 4, wherein the cutting mechanism comprises a cutting tool movably mounted onto the chassis along at least an axis parallel to the longitudinal axis of the cylindrical package holder.

6. The dispenser according to claim 1, wherein the cylindrical package holder is configured for holding at least two array-type pill packages contiguously on said cylindrical periphery.

7. The dispenser according to claim 1, further comprising a clamping frame configured for holding the array-type package against the cylindrical package holder, the clamping frame being movably connected to the cylindrical package holder between a latched configuration and an unlatched configuration.

8. The dispenser according to claim 7, further comprising a registering mechanism mounted to at least one of the cylindrical package holder and the clamping frame for registering the array-type package with the cylindrical package holder.

9. The dispenser according to claim 8, wherein the registering mechanism comprises a plurality of through openings each shaped and positioned to tightly receive a corresponding one of the plurality of individual containers of the array-type package.

10. The dispenser according to claim 7, further comprising a latching mechanism connected to the cylindrical package holder and the clamping frame to releasably latch the clamping frame onto the cylindrical package holder when in the latched configuration, with the common top surface of the array-type package held therebetween.

11. The dispenser according to claim 7, wherein the clamping frame is generally flexible so as to define a generally cylindrically curved shape when in the latched configuration and a generally planar shape when in the unlatched configuration.

12. The dispenser according to claim 7, wherein the clamping frame is hingedly mounted onto the cylindrical package holder.

* * * * *